United States Patent [19]

Martinmaas

[11] 4,281,568

[45] * Aug. 4, 1981

[54] QUICKLY ADJUSTABLE RATCHET WRENCH

[76] Inventor: Werner W. Martinmaas, 650 S. Rock Blvd.-Unit 3, Reno, Nev. 89502

[ * ] Notice: The portion of the term of this patent subsequent to Jul. 29, 1997, has been disclaimed.

[21] Appl. No.: 46,801

[22] Filed: Jun. 8, 1979

[51] Int. Cl.[3] ..... B25B 13/14

[52] U.S. Cl. ..... 81/134; 81/142

[58] Field of Search ..... 81/126, 127, 129, 130 R, 81/134, 355, 357, 359, 360, 386, 392

[56] References Cited

U.S. PATENT DOCUMENTS

| | | | |
|---|---|---|---|
| 2,774,271 | 12/1956 | Mano | 81/127 |
| 3,407,689 | 10/1968 | Slayton | 81/134 |

*Primary Examiner*—James G. Smith

*Attorney, Agent, or Firm*—Wegner, Stellman, McCord, Wood & Dalton

[57] ABSTRACT

A quickly adjustable ratchet wrench is essentially a crescent wrench modified by eliminating the adjusting screw and substituting a locking member and a lever to engage and disengage the locking member with the rack on the movable wrench jaw. A tension spring lightly biases the movable jaw toward closed position. With the locking member disengaged from the rack, the movable jaw may be manually opened, and when the movable jaw is released the light spring bias closes the jaws on a bolt head. When the wrench jaws are engaged with a bolt head, rotation of the lever arm in one direction engages the locking member with the rack to turn the bolt, while rotation of the lever arm in the other direction disengages the locking member and permits the jaws to open against the light spring bias and slip over the angles of the bolt head; thus eliminating the need to remove and replace the wrench on the bolt head. The lever is pivoted substantially on the line of movement of the movable jaw. The rack on the movable jaw is convex so as to include part of the sides of the jaw, and the locking member is concave so as to engage substantially the entire rack. A telescoping spring anchor permits elimination of spring tension when desired.

10 Claims, 5 Drawing Figures

QUICKLY ADJUSTABLE RATCHET WRENCH

CROSS REFERENCE TO RELATED APPLICATIONS

This application discloses and claims improvements on the Quickly Adjustable Ratchet Wrench of copending application Ser. No. 909,104 filed May 24, 1978, now abandoned.

BACKGROUND OF THE INVENTION

A feature of socket wrenches which makes them very easy to use is the one-way ratchet connection between the wrench handle and the socket-receiving stub, so that once a wrench socket is engaged with a bolt head the handle can be turned clockwise to tighten the bolt and turned counterclockwise to start a new stroke without having to disconnect the socket from the bolt head. Socket wrenches, however, have the disadvantage that a different socket is required for each size bolt head.

There are several varieties of adjustable wrenches, but all those applicant has seen must be disengaged from a bolt head and re-engaged on each stroke. This is particularly time-consuming where the location of the bolt to be tightened is such that nearby obstructions limit the length of the wrench stroke and thus necessitate frequent disconnection and reconnection of the wrench with the bolt head. In this respect, adjustable wrenches are similar to spanners, hex wrenches and box wrenches.

The following patents show crescent wrenches which have levers for quick adjustment of the jaw span; but none of them provides a ratchet connection: U.S. Pat. Nos. Sokolov 1,159,428, Shackford 1,434,753, Wettwer 1,452,668, Purdy 1,720,650, Hogstadius 2,587,320 Nordgren 2,970,502, Allegraud 3,232,150 and Miller 4,106,372.

Orr U.S. Pat. No. 3,000,245 discloses a side jaw wrench which has a ratchet action but the mechanism is much more complex and delicate than is that of the present invention.

The principal object of the present invention is to provide an adjustable wrench which may be rotated clockwise to tighten the bolt; and the handle of which may be turned counterclockwise to start a new stroke without disengaging the wrench from the bolt head or returning the bolt to the position that it occupied before the stroke was started.

Another object of the invention is to provide an adjustable wrench which may be quickly opened and closed upon the head of a bolt which is to be tightened.

A further object of the invention is to provide such a wrench in which pressure applied to the wrench while tightening a bolt or nut has no tendency to free the movable wrench jaw.

Still a further object of the invention is to provide such a wrench which is so constructed as to eliminate the possibility of laterally displacing the movable jaw.

Yet another object of the invention is to provide such a wrench in which a tension spring lightly urges the movable jaw toward the fixed jaw, and in which spring tension may be entirely eliminated when desired.

The foregoing objects of the invention are realized by constructing a quickly adjustable ratchet wrench having the following elements:

A quickly adjustable ratchet wrench for rotating objects which have angularly related flat surfaces surrounding an axis of rotation, said wrench being of the type which has a fixed jaw member having a jaw element and a handle, a movable jaw member having a jaw element and an elongated engaging surface, and means mounting said movable jaw member for linear translatory movement on the fixed jaw member between closed and open positions of said jaw elements. A jaw spring lightly biases the movable jaw member toward closed position so that the fixed and movable jaw elements normally close lightly upon an object between them. Locking means including a locking face on the fixed jaw member is selectively engageable with the engaging surface of the movable jaw member to lock the jaw elements closed upon an object between them.

A lever is pivoted on the fixed jaw member on a pivot axis substantially on the line of linear translatory movement of the movable jaw member, and pivotal movement of the lever engages and disengages the engaging surface and the locking face. The lever has a transverse surface which bears on a part of the fixed jaw member when the engaging surface and the locking face are engaged so that manual force applied to the lever is transmitted through the fixed jaw member to rotate an object upon which the jaws are closed, and which pivots away from said part of the fixed jaw member to disengage said engaging surface and locking face and thereby releases the movable jaw member for free linear movement against the bias of the spring; and the lever is so related to the fixed jaw member that a user may manually grip the lever with one hand while leaving the fixed jaw member free, whereby in normal reciprocating action the movable wrench jaw is alternately locked to grip opposite flat surfaces of an object between the jaw elements and released for free rotation of the jaw elements around angles between adjacent flat surfaces of the object without rotating said object.

In a preferred embodiment of the invention, the tension on the spring may be completely released when desired.

In a most preferred embodiment the elongated engaging surface of the movable jaw member is convex so as to include part of the sides of said movable jaw member, and the locking face is concave so as to be engageable with substantially all of said engaging surface.

To simplify the detailed description and claims, the operation of the wrench is described as it is used to tighten a bolt. To loosen or remove a bolt, of course, the position of the wrench on the bolt is reversed so that the working stroke is counterclockwise and the idle stroke is clockwise.

Further, the term "lightly biasing" with reference to the biasing springs is used as a general limitation upon the force with which the movable jaw of the wrench may be biased toward closed position. The biasing force must be small enough that when the lever arm is rotated counter-clockwise to start a new working stroke, the jaws can open sufficiently against the spring bias to slip around the angles of the bolt head instead of loosening the bolt. This, of course, limits the biasing force that can be applied to the movable jaw by the spring.

The engaging surface of the movable jaw member is shown in the drawings as a toothed rack, and the locking face is shown with lugs engaging the rack; and those terms are usually employed hereinafter.

The present device is called a ratchet wrench as a matter of convenience, and not as a precise definition of function; because it does not operate as does a conventional ratchet. When the lever arm is rotated counterclockwise to release the locking lugs from the rack teeth to start a new stroke of the wrench, the locking lugs merely retract from the teeth; and as the jaws spread to go around the angles of the bolt head the rack moves a short distance relative to the locking member. When the jaws again close upon opposite flat sides of the bolt head the rack returns to its original position, and the locking lugs re-engage with the same teeth upon renewed clockwise rotation of the wrench. For practical purposes the wrench may be thought of as a ratchet wrench; but in fact it does not, mechanically, operate as does a ratchet.

THE DRAWINGS

DETAILED DESCRIPTION OF THE INVENTION

Figures 1, 2, 3, 4, 5:
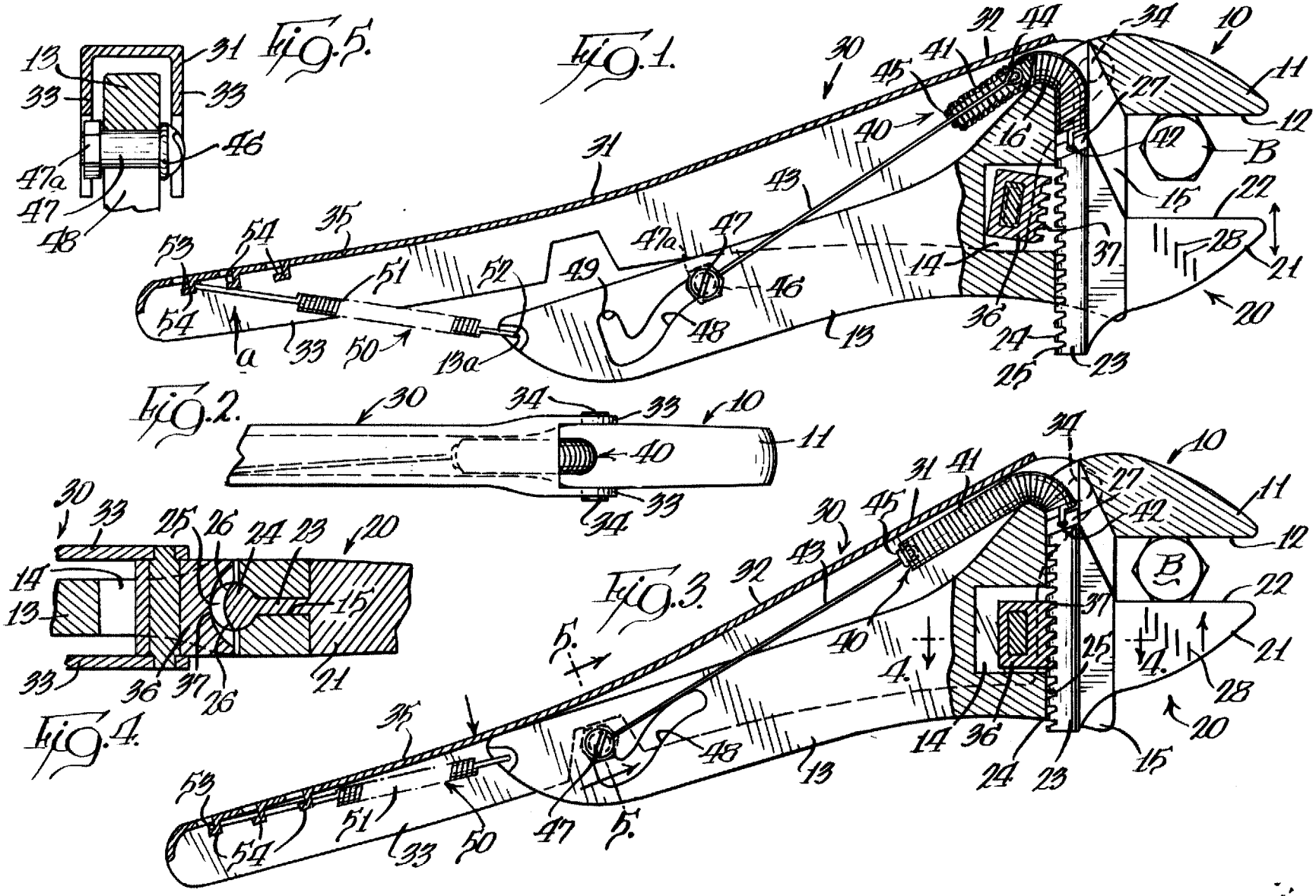
FIG. 1 is a longitudinal sectional view of a wrench embodying the invention with the locking lever arm and locking member in release position.
FIG. 2 is a fragmentary plan view of a wrench embodying the invention.
FIG. 3 is a view similar to FIG. 1 with the lever arm and locking member in engaged position.
FIG. 4 is a fragmentary sectional view on an enlarged scale taken substantially as indicated along the line 4—4 of FIG. 3.
FIG. 5 is a fragmentary sectional view on an enlarged scale taken substantially as indicated along the line 5—5 of FIG. 3.

Referring to the drawings in greater detail, the quickly adjustable ratchet wrench of the present invention consists, generally, of a fixed jaw member, indicated generally at 10; a movable jaw member, indicated generally at 20; manually releasable locking means, indicated generally at 30; and a jaw spring, indicated generally at 40.

The fixed jaw member 10 has a fixed jaw element 11 at its forward portion, and the fixed jaw element has a gripping surface 12. An integral extension 13 extends rearwardly with respect to the fixed jaw element 11, and there is a forwardly open recess 14 at the front of the extension below the plane of the gripping surface 12. A slideway 15 is positioned between the fixed jaw element 11 and the recess 14.

Adjacent the upper end of the slideway 15 the fixed jaw member 10 has a smoothly curved transverse surface 16 which is grooved to accommodate the jaw spring 40.

The movable jaw member 20 includes a movable jaw element 21 with a gripping surface 22 which closes against the gripping surface 12 of the fixed jaw element 11; and to the rear of the movable jaw element 21 is a vertically extended supporting portion 23 by means of which the movable jaw member 20 is carried in the slideway 15 for linear translatory movement so as to open and close the jaws 11-21.

At the extreme rear of the movable jaw member 20 is an elongated engaging surface 24 in the form of a convex rack having teeth 25 which traverse the front of the recess 14 as the jaw member 20 is moved in the slideway 15. The teeth have portions 26 at their lateral extremities which include parts of the sides of the movable jaw member.

The elements as heretofore described are essentially the same as those in a conventional crescent wrench, except for the smoothly curved transverse surface 16 to accommodate the jaw spring 40 and the convex conformity of the rack teeth 25 with their lateral extremities 26. In addition, as illustrated in the drawings the extension 13 is much shorter than a conventional crescent wrench handle. In a crescent wrench an adjusting screw occupies the recess 14 and engages the rack teeth 25 in order that the position of the movable jaw member 20 may be adjusted by manual rotation of the screw. In the present structure the screw is eliminated; and the manually releasable locking means 30 and jaw spring 40 are substituted.

The movable jaw member 20 has an upright spring anchor 27 surmounting the supporting portion 23; and the sides of the movable jaw element 21 are provided either with grooves or ribs 28 to facilitate manual movement of the movable jaw member 20 against the light biasing force applied by the jaw spring 40.

The manually releasable locking means 30 includes a lever 31 which is of channel shape with a back web 32 overlying the extension 13 and side webs 33 the more forward portions of which flank the extension 13 and receive pivot studs 34 which are formed integrally with the fixed jaw member 10 flanking the upper part of the slideway 15. The lever 31 has a lever arm 35 which extends a substantial distance to the rear of the extension 13.

A locking member 36 is fixedly mounted between the lever side webs 33 in the recess 14, and has a concave locking face in the form of a plurality of locking lugs 37 which engage with adjacent teeth 25 of the rack 24, including their lateral extremities 26, when the lever 31 is in the position of FIG. 3 in which its top web 32 abuts the extension 13. It is apparent that the rack teeth 25 and the locking lugs 27 are merely exemplary of suitable structure. The longitudinal convex surface 24 of the movable jaw, and the concave locking face could be transversely striated, or otherwise roughened enough to prevent slippage between the movable jaw member 20 and the locking member 36.

Clockwise movement of the lever arm 35 away from the extension 13, as indicated by the arrow a in FIG. 1, moves the locking member 36 from the operative position of FIG. 3, in which its concave locking lugs 37 are engaged with the convex teeth 25-26, to the idle position of FIG. 1 in which the movable jaw member 20 is free to slide in the slideway 15.

The jaw spring 40 is anchored to the extension 13 of the fixed jaw member 10 and lightly biases the movable jaw member 20 toward closed position. Specifically, the jaw spring 40 constitutes a coil tension spring 41 at one end of which is a hook 42 which engages the spring anchor 27 at the top of the movable jaw member 20.

The end of the coil tension spring 41 opposite the hook 42 is telescopingly engaged by a spring anchor member 43 in the form of a wire which has a proximal end portion inside the spring and provided with a button 44 which engages a transverse eye 45 formed integrally with the spring, so the spring may be tensioned by pulling the wire.

A loop 46 at the distal end of the wire receives a lug consisting of a bolt 47 that extends through a slot 48 in the fixed jaw extension 13 and is secured by a lock nut **47*a* so as to be freely slidable in the slot. At the end of the slot 48 opposite the spring 41 is a recess 49 in which the lug seats firmly to hold the spring anchor wire 43 in a first position tensioning the spring 41. When the lug is freed from the recess 49 and moved to the opposite end of the slot 48 the proximal end of the anchor wire 43 telescopes in the spring 41 so as to take all tension off the spring. This may be useful in case of a malfunction of the movable jaw 20 or the releasable locking means 30**.

The coil spring 41 extends around the smoothly curved transverse surface 18 adjacent the slideway 15; and the top of the fixed jaw member 10 cooperates with the back web 32 of the lever 31 to protect the spring 41 in case somebody uses the back of the wrench as a hammer.

When the wrench is to be used, the lever arm 35 is rotated clockwise to release the movable jaw 20, which may then be manually moved so that the space between the gripping surfaces 12 and 22 is slightly greater than the span across a bolt head B to be engaged, and the lever arm is then returned to its position abutting the extension 13 to maintain this setting of the movable jaw member 20. The wrench is then positioned with the gripping surfaces 12 and 22 at opposite sides of the bolt head, and the lever is again moved to release the movable jaw so that the jaw spring closes the movable jaw against the bolt head B. Counterclockwise rotation of the lever arm 35 then applies force through the concave locking lugs 37 and the convex rack teeth 25–26 to turn the bolt in the direction to tighten it. When a first stroke of the wrench is completed, light counterclockwise pressure on the rearward portion of the lever arm 35 that extends behind the extension 13 will disengage the locking lugs 37 from the teeth 25–26 so that the movable jaw element 21 is free to move away from the fixed jaw element 11 against the light bias of the jaw spring 41 so that the gripping surfaces 12 and 22 of the jaws may slip around the angles of the bolt head and again close upon the opposite flat sides of the bolt head. Thereupon another clockwise stroke of the lever arm 35 further tightens the bolt. The location of the pivot studs 34 flanking the upper part of the slideway 15 causes pressure applied to the wrench while tightening a bolt or nut to function always to lock the locking lugs 37 with the movable wrench jaw member 20, rather than tending to release them as can be the case if the pivot for the lever is located farther back on the fixed jaw member 10.

In order that the locking lugs may properly engage the rack teeth 25 when the jaw gripping surfaces 12 and 22 are closed upon a bolt head, the space between the teeth 25 and the corresponding space between the locking lugs 37 is preferably coordinated with the span across the flat sides of bolt heads of different sizes, so that the lugs and the teeth are engaged when the gripping surfaces are fully closed upon the flat sides of a bolt head.

The wrench of the present invention also includes adjustable lever spring means, indicated generally at 50, which automatically returns the lever arm 35 to the position of FIG. 3 in order to retain the movable jaw member 20 in the illustrated open position as soon as clockwise rotational force is taken off the lever arm. As a result, the wrench may be positioned relative to a bolt head B as seen in FIG. 1 without the need for manually holding the movable jaw member 20 in its extreme open position. Clockwise movement of the lever arm 35 then releases the rack teeth 25–26 so that the jaw spring means 40 can slide the movable jaw element 21 into engagement with the bolt head B.

The lever spring means 50 consists of a coil spring 51 which has engaging means 52 in the form of a hook engaged with a hole 13*a* at the extreme rear of the extension 13, and engaging means 53 in the form of an eye which may be selectively engaged with any of a series of spaced hooks 54 which are shear formed in the back web 32 of the lever arm 35.

The foregoing detailed description has been given for clearness of understanding only and no unnecessary limitations should be understood therefrom as modifications will be obvious to those skilled in the art.

I claim:

1. In a quickly adjustable ratchet wrench for rotating objects which have angularly related flat surfaces surrounding an axis of rotation, said wrench being of the type which has a fixed jaw member having a jaw element and a rearward extension, a movable jaw member having a jaw element and an elongated engaging surface, and means mounting said movable jaw member for linear translatory movement of the fixed jaw member between closed and open positions of said jaw elements, the improvement comprising:

a jaw spring lightly biasing said movable jaw member toward closed position so that said fixed and movable jaw elements normally close lightly upon an object between them, said jaw spring being a tension spring which has one end secured to the top of the movable jaw member and the other end telescopically engaging a proximal end of an anchor member, a lug on the distal end of said anchor member, and means on the rearward extension of the fixed jaw member for locating said lug selectively in a first position with the spring tensioned by the anchor member or in a second position with the proximal end of the anchor member telescoped along the spring to eliminate the spring tension;

locking means including a locking face on the fixed jaw member which is selectively engageable with said engaging surface to lock the jaw elements closed upon an object between them;

and a lever pivoted on the fixed jaw member on a pivot axis substantially on the line of linear translatory movement of the movable jaw member, pivotal movement of said lever engaging and disengaging said engaging surface and said locking face, said lever having a transverse surface which bears on said rearward extension of the fixed jaw member when the engaging surface and the locking face are engaged so that manual force applied through the lever against said rearward extension rotates an object upon which the jaws are closed, and which pivots away from said rearward extension to disengage said engaging surface and locking face and thereby release the movable jaw member for free linear movement against the bias of the spring, said lever being so related to said rearward extension that user may manually grip the lever with one hand while leaving the rearward extension free to permit manual reciprocation of the wrench with the movable wrench jaw alternately locked to grip opposite flat surfaces of an object between the jaw elements to rotate said object and released for free rotation of the jaw elements around angles between adjacent flat surfaces of the object without rotating said object.

2. The improvement of claim 1 in which the means on the rearward extension of the fixed jaw member comprises a slot in which the lug is movable between said first and second positions, and there is a recess at an end of the slot remote from the spring to fix the lug in said first position.

3. The improvement of claim 1 or 2 in which the elongated engaging surface of the movable jaw member is convex so as to include part of the sides of said movable jaw member, and the locking face is concave so as to be engageable with substantially all of said engaging surface.

4. In a quickly adjustable ratchet wrench for rotating objects which have angularly related flat surfaces surrounding an axis of rotation, said wrench being of the type which has a fixed jaw member having a jaw element, a movable jaw member having a jaw element and an elongated engaging surface, and means mounting said movable jaw member for linear translatory movement on the fixed jaw member between closed and open positions of said jaw elements, the improvement comprising:

the elongated engaging surface of the movable jaw member is convex so as to include part of the sides of said movable jaw member;

a jaw spring lightly biasing said movable jaw member toward closed position so that said fixed and movable jaw elements normally close lightly upon an object between them, said jaw spring being a tension spring which has one end secured to the top of the movable jaw member and the other end telescopically engaging a proximal end of an anchor member, a lug on the distal end of said anchor member, and means on the rearward extension of the fixed jaw member for locating said lug selectively in a first position with the spring tensioned by the anchor member or in a second position with the proximal end of the anchor member telescoped along the spring to eliminate the spring tension;

locking means including a concave locking face on the fixed jaw member which is selectively engageable with substantially all of said engaging surface to lock the jaw elements closed upon an object between them;

and a lever pivoted on the fixed jaw member for engaging and disengaging said engaging surface and said locking face, said lever having a transverse surface which bears on a part of the fixed jaw member when the engaging surface and the locking face are engaged so that manual force applied to the lever is transmitted through the fixed jaw member to rotate an object upon which the jaws are closed, and which pivots away from said part of the fixed jaw member to disengage said engaging surface and locking face and thereby release the movable jaw member for free linear movement against the bias of the spring, said lever being so related to the fixed jaw member that a user may manually grip the lever with one hand while leaving the fixed jaw member free, whereby in normal reciprocating action the movable wrench jaw is alternately locked to grip opposite flat surfaces of an object between the jaw elements and released for free rotation of the jaw elements around angles between adjacent flat surfaces of the object without rotating said object.

5. The improvement of claim 4 in which the means on the handle of the fixed jaw member comprises a slot in which the lug is movable between said first and second positions, and there is a recess at an end of the slot remote from the spring to fix the lug in said first position.

6. A quickly adjustable ratchet wrench for rotating objects which have angularly related flat surfaces surrounding an axis of rotation, said wrench being of the type which has a fixed jaw member having a jaw element and a rearward extension, a movable jaw member having a jaw element and an elongated engaging surface, and means mounting said movable jaw member for linear translatory movement on the fixed jaw member between closed and open positions of said jaw elements, and said wrench being characterized by:

a tension spring lightly biasing said movable jaw member toward closed position so that said fixed and movable jaw elements normally close lightly upon an object between them, said tension spring having one end secured to the top of the movable jaw member and the other end telescopically engaging a proximal end of an anchor member, and a lug on the distal end of said anchor member;

means on the rearward extension of the fixed jaw member for locating said lug selectively in a first position with the spring tensioned by the anchor member or in a second position with the proximal end of the anchor member telescoped along the spring to eliminate the spring tension;

locking means including a locking face on the fixed jaw member which is selectively engageable with said engaging surface to lock the jaw elements closed upon an object between them;

and a lever pivoted on the fixed jaw member for engaging and disengaging said engaging surface and said locking face, said lever having a transverse surface which bears on said rearward extension of the fixed jaw member when the engaging surface and the locking face are engaged so that manual force applied through the lever against said rearward extension rotates an object upon which the jaws are closed, and which pivots away from said rearward extension to disengage said engaging surface and locking face and thereby release the movable jaw member for free linear movement against the bias of the spring, said lever being so related to said rearward extension that a user may manually grip the lever with one hand while leaving the rearward extension free to permit manual reciprocation of the wrench with the movable wrench jaw alternately locked to grip opposite flat surfaces of an object between the jaw elements to rotate said object and released for free rotation of the jaw elements around angles between adjacent flat surfaces of the object without rotating said object.

7. The improvement of claim 6 in which the means on the rearward extension of the fixed jaw member comprises a slot in which the lug is movable between first and second positions, and there is a recess at an end of the slot remote from the spring to fix the lug in said first position.

8. In a quickly adjustable ratchet wrench for rotating objects which have angularly related flat surfaces surrounding an axis of rotation, said wrench being of the type which has a fixed jaw member having a jaw element, a slideway normal to the plane of said jaw element, and a rearward extension, a movable jaw member having a jaw element, a supporting portion reciprocable in said slideway which mounts said movable jaw member for linear translatory movement on the fixed jaw member between closed and open positions of said jaw elements, and said movable jaw member having an elongated engaging surface, the improvement comprising:

a jaw spring lightly biasing said movable jaw member toward closed position so that said fixed and movable jaw elements normally close lightly upon an object between them;

locking means supported on the fixed jaw member including a locking face which is selectively engageable with said engaging surface to lock the jaw elements closed upon an object between them;

a pair of aligned external pivot bosses on the sides of the fixed jaw member in a transverse plane through the upper end portion of said slideway;

and a lever which has parallel webs that flank the upper forward part of the fixed jaw member and have aligned holes into which said pivot bosses extend to pivotally support the lever on said bosses, pivotal movement of said lever engaging and disengaging said engaging surface and said locking face, said lever being a transverse surface which bears on said rearward extension of the fixed jaw member when the engaging surface and the locking face are engaged so that manual force applied through the lever against said rearward extension rotates an object upon which the jaws are closed, and which pivots away from said rearward extension to disengage said engaging surface and locking face and thereby release the movable jaw member for free linear movement against the bias of the spring, said lever being so related to said rearward extension that user may manually grip the lever with one hand while leaving the rearward extension free to permit manual reciprocation of the wrench with the movable wrench jaw alternately locked to grip opposite flat surfaces of an object between the jaw elements to rotate said object and released for free rotation of the jaw elements around angles between adjacent flat surfaces of the object without rotating said object.

9. In a quickly adjustable ratchet wrench for rotating objects which have angularly related flat surfaces surrounding an axis of rotation, said wrench being of the type which has a fixed jaw member having a jaw element, a slideway normal to the plane of said jaw element, a movable jaw member having a jaw element, a supporting portion reciprocable in said slideway which mounts said movable jaw member for linear translatory movement on the fixed jaw member between closed and open positions of said jaw elements, and said movable jaw member having an elongated engaging surface, the improvement comprising:

a jaw spring lightly biasing said movable jaw member toward closed position so that said fixed and movable jaw elements normally close lightly upon an object between them;

locking means including a locking face on the fixed jaw member which is selectively engageable with said engaging surface to lock the jaw elements closed upon an object between them;

a pair of aligned external pivot bosses on the sides of the fixed jaw member in a transverse plane through the upper end portion of said slideway;

and a lever on the fixed jaw member which has parallel webs that flank the upper forward part of the fixed jaw member and have aligned holes into which said pivot bosses extend to pivotally support the lever on said bosses, pivotal movement of said lever engaging and disengaging said engaging surface and said locking face, said lever having a transverse surface which bears on a part of the fixed jaw member when the engaging surface and the locking face are engaged so that manual force applied to the lever is transmitted through the fixed jaw member to rotate an object upon which the jaws are closed, and which pivots away from said part of the fixed jaw member to disengage said engaging surface and locking face and thereby release the movable jaw member for free linear movement against the bias of the spring, said lever being so related to the fixed jaw member that a user may manually grip the lever with one hand while leaving the fixed jaw member free, whereby in normal reciprocating action the movable wrench jaw is alternately locked to grip opposite flat surfaces of an object between the jaw elements and released for free rotation of the jaw elements around angles between adjacent flat surfaces of the object without rotating said object.

10. The improvement of claim 8 or 9 in which the elongated engaging surface of the movable jaw member is convex so as to include part of the sides of said movable jaw member, and the locking face is concave so as to be engageable with substantially all of said engaging surface.

* * * * *